US005443269A

United States Patent [19]

Loritz

[11] Patent Number: 5,443,269

[45] Date of Patent: Aug. 22, 1995

[54] SELF CONTAINED GAME ASSEMBLY

[76] Inventor: Steven R. Loritz, 245 N. Singingwood, #9, Orange, Calif. 92669

[21] Appl. No.: 308,980

[22] Filed: Sep. 20, 1994

Related U.S. Application Data

[63] Continuation of Ser. No. 200,276, Feb. 22, 1994, abandoned.

[51] Int. Cl.[6] ..... A63F 7/02

[52] U.S. Cl. ..... 273/241; 273/283

[58] Field of Search ..... 273/283, 284, 285, 287, 273/126 R, 128 R, 241; 206/315.1, 579

[56] References Cited

U.S. PATENT DOCUMENTS

| | | | |
|---|---|---|---|
| D. 23,036 | 2/1894 | Gardner | 273/241 |
| 1,877,154 | 9/1932 | Weaver | 273/241 |
| 3,399,895 | 9/1968 | Beach | 273/241 |
| 3,462,149 | 8/1969 | Grusin | 273/126 R |
| 3,684,285 | 8/1972 | Kane | 273/241 |
| 3,695,614 | 10/1972 | Brisson | 273/241 |
| 4,082,283 | 4/1978 | La Ferla et al. | 273/241 |
| 4,720,107 | 1/1988 | Peters et al. | 273/128 R X |
| 5,195,750 | 3/1993 | Courialis | 273/241 |
| 5,338,040 | 8/1994 | Cutler | 273/241 |

FOREIGN PATENT DOCUMENTS

| | | | |
|---|---|---|---|
| 1460250 | 12/1976 | United Kingdom | 273/241 |
| 1734806 | 5/1992 | U.S.S.R. | 273/241 |
| 8400697 | 3/1984 | WIPO | 273/241 |

*Primary Examiner*—William E. Stoll
*Attorney, Agent, or Firm*—G. Donald Weber, Jr.

[57] ABSTRACT

A board game assembly wherein the board is adapted to provide a playing surface for the game and, as well, a storage unit for storing the playing pieces therein. The playing pieces can be in the form of collectible items.

18 Claims, 1 Drawing Sheet

SELF CONTAINED GAME ASSEMBLY

This is a continuation of application Ser. No. 08/200,276, filed Feb. 22, 1994, now abandoned.

BACKGROUND

1. Field of the Invention

This invention relates to a board game assembly, in general, and, more specifically, to a self-contained game assembly including a game board and playing pieces.

2. Prior Art

As a consequence of the rapidly growing phenomena related to the collection of various forms of memorabilia and, especially, trading cards, an new industry has developed. The trading card industry, initially fueled by the rise in popularity of collecting baseball cards, now comprises not only baseball cards, but also football, basketball, and hockey cards, as well as many other non-athletic oriented areas such as cartoon characters, celebrities, and the like. The escalation in the value of many collectibles, led by the escalation in the value of baseball cards, has generated a great interest in a number of new collectible areas and has rekindled interest in some long- dormant collectibles. The collection of milk bottle caps or juice bottle caps for hobby and profit, has once again become a very popular activity. Many manufacturers of milk and juice bottle caps have become hard-pressed to keep up with the demand for these collectibles. One major contributing factor to the great popularity of bottle cap collecting among children and adults is the resurgence of a game known by various names, most commonly "The Milk Cap Game".

In the game of "Milk Caps", or as it is now popularly referred to, "POGS", a stack of bottle caps is placed on a flat, solid surface, usually the floor, but, alternatively, the sidewalk, playground, street, or the like. Each player takes turns "slamming" a heavier or weighted cap down on top of the stack. The goal of playing "POGS" is to dislodge and flip over as many of the stacked caps as possible. Typically, the caps which are turned over are captured or won by the successful participant.

The game of POGS, as with the ageless game of marbles, involves the development Of certain skills which, when refined, result in players being rewarded by being able to capture an increased number of valuable caps.

The game of "POGS" has become so popular in certain parts of the country that it has replaced many traditional "street games". For example, "POGS" tournaments are held throughout the Hawaiian Islands, especially on the island of Oahu, and this activity is rapidly expanding to the United States mainland.

SUMMARY OF THE INSTANT INVENTION

This invention provides a self-contained, portable game assembly whereby various traditional street games, such as "POGS", may be played. By providing a portable playing surface support with integrated storage space and containers for the storage of playing discs, the game can be played anywhere.

The self-contained game assembly of the present invention makes the game amenable to playing in a more convenient and safe board game format. By utilizing the board game assembly provided by the invention, many non-traditional venues can be utilized for playing the game. The need for a large, flat surface and is eliminated as the playing surface support can now be substituted. Additionally, a plurality of caps or discs can be stored within the board assembly. Storage space integrally designed into the playing surface support permits an orderly storage and accounting of the discs between games.

DESCRIPTION OF A PREFERRED EMBODIMENT

Figure 1:
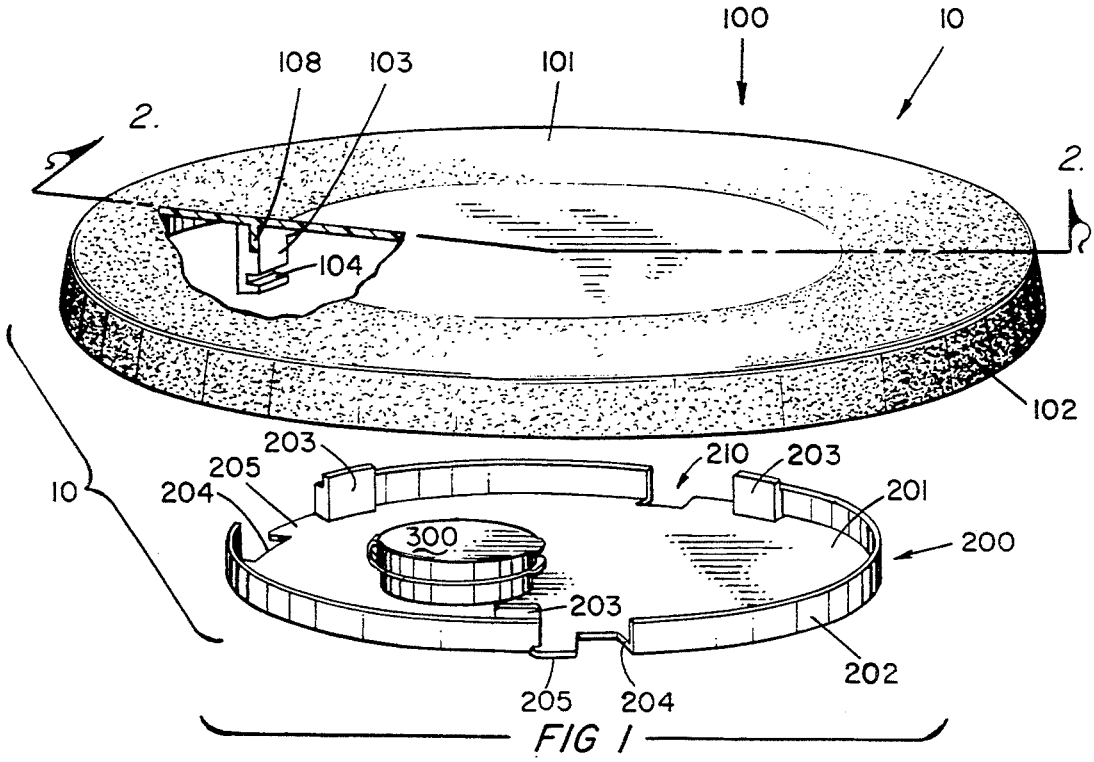
FIG. 1 is an exploded, partially broken away view of one embodiment of the playing surface support or assembly of the instant invention.

FIG. 1 shows an exploded, partially broken away view of one embodiment of playing surface support or assembly 10 of the instant invention. The assembly 10 is comprised of an upper support component 100 and a lower or storage component 200. The upper support component 100 overlies the storage component 200 and interlocks therewith.

In particular, the upper support component has an upper wall 101 which has a relatively flat and smooth outer surface. This surface is the actual playing surface provided by the support 100 of the assembly 10. The upper wall 101 is formed as a relatively thin, but relatively strong wall or panel. The wall or panel can be fabricated of any suitable material such as plastic, metal or wood.

The upper wall 101, in a preferred embodiment, includes a depending wall 102 which forms a type of skirt or outer peripheral wall for the upper support component 100. The peripheral wall 102 and the upper wall 101 are generally formed of the same material and are integrally formed.

A plurality of connectors 103 depend from the under surface of upper wall 101. These connectors are, typically, slightly longer than the outer wall 102. Thus, the connectors 103 extend slightly beyond the lower edge of the outer wall 102.

The connectors 103 include a slot 104 therein which is adapted to receive and engage the lower storage component 200, as described hereinafter. The slot 104 is, preferably, tapered to enhance the engagement of the components. While the number of connectors 103 can be any suitable or desired number, the preferred embodiment includes three (3) connectors for minimum cost and satisfactory connection of the parts.

A relatively short inner wall 108, concentric with outer wall 102, extends downwardly from the inner surface of upper wall 101. The inner wall 108 joins the connectors 103.

The lower storage component 200 includes a relatively flat bottom wall 201 with a peripheral upstanding edge wall 202. The upper edge of wall 202 abuts the lower edge of inner wall 108 (as shown best in FIG. 2). The wall 202 has a number of openings 210 therein, The number of openings 210 is the same as the number of connectors 103 in the upper portion 100, Adjacent each of the openings there is a stopper 203 which limits the rotation of the storage unit 200 relative to the support component 100. Also, adjacent to each opening 210 is a cutout portion 204 of bottom wall 201 which extends inwardly towards the center of the bottom wall 201, It will be seen that the cutouts 204 are adapted to receive the respective connectors 103.

Also, a lip 205 extends outwardly beyond the plane or surface of wall 202. This lip or tab 205 is adapted to engage connector 103 and to lock into the gap 104 in the connector 103. That is, the components 100 and 200 are assembled by placing upper support component 100 over the storage component 200 with the connectors 103 aligned with the openings 210. The components 100 and 200 are then rotated relative to each other wherein the tab 205 slides into gap 104 in the respective connector 103. This engagement is sufficiently secure that the components 100 and 200 do not easily disengage. However, the components 100 and 200 can be readily disengaged by a user through the expedient of rotating the parts in the opposite direction whereby lip 205 disengages from slot 104.

As shown in FIG. 1, a container 300 (described hereinafter) is mounted within the storage component 200. The container 300 is generally cylindrical in configuration and resides within the storage component 200 when the support component 100 is attached to storage component 200.

Figure 2:
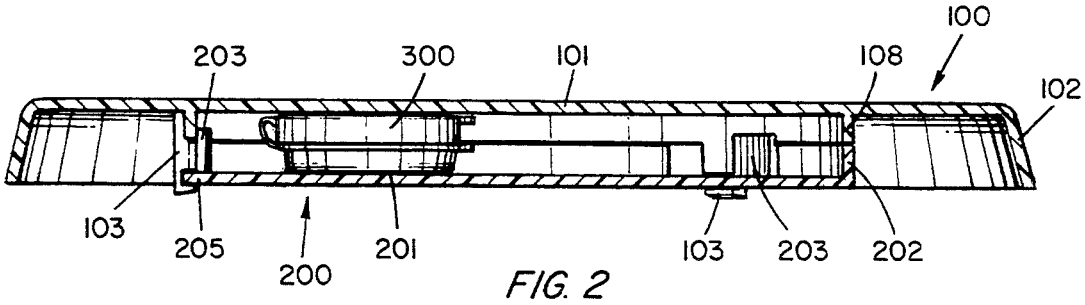
FIG. 2 is a cross sectional view of the playing surface support of the assembly embodiment taken along the line 2—2 in FIG. 1.

Referring now to FIG. 2, there is shown a cross-sectional view of the assembly 10 of the instant invention taken along the line 2—2 in FIG. 1. As described supra, the upper component 100 includes the upper planar wall 101 and the depending outer wall 102. The walls 101 and 102 can be integrally formed during a molding process or the like.

In addition, the connectors 103 depend from the inner surface of upper wall 101 and include the gap 104 therein. The connectors are, preferably, integrally formed at the under surface of wall 101.

In the embodiment shown in FIG. 2, the storage unit 200 has been assembled and engaged with the upper support unit 100. In particular, the surface of bottom wall 201 has been placed in parallel with the surface of upper wall 101. The openings 204 have been presented so as to receive the connectors 103. In the embodiment shown in FIG. 2, the lower storage unit 200 has been rotated slightly, on the order of a few degrees of rotation, so that the lip or tab 205 engages with the slot 104 in connector 103.

Inasmuch as there are a plurality of such connectors and such interconnecting or engaging lips, the storage unit 200 is maintained in a locked condition relative to the upper or cover component 100.

The storage component 300 is shown stored in storage compartment 200 and maintained in a moderately secured, although possibly slidable, arrangement by the upper support portion 100.

As noted, portable playing surface support 100 may be contructed of any sturdy material such as plastic, metal or wood. The size and shape of support 100 may be of any configuration and/or dimension that allows for easy access and storage in the traditional board game format. In the preferred embodiment, a circular (or cylindrical) configuration is utilized.

Figure 3:
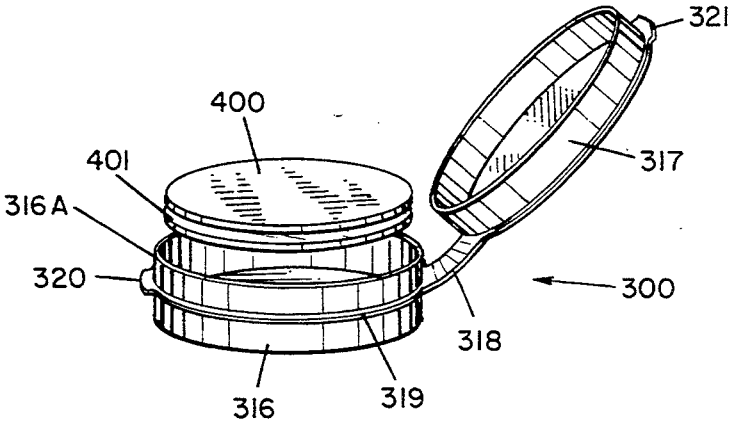
FIG. 3 is a perspective view of a storage container along with a game piece.

Referring now to FIG. 3, there is shown a perspective view of one embodiment of an individual storage container 300 and a game piece 400. In particular, the container comprises a storage area 316 and a cover 317. Any suitable arrangement can be made by which cover 317 is selectively engaged with storage area 316. In the preferred embodiment, storage area 316 is joined to cover 317 by a flexible strap 318, such as a so-called "living hinge". In this embodiment, storage container 300 comprises a unitary, molded assembly comprising storage component 316 and cover component 317. However, the storage area 316 and the cover 317 can be separate components.

The container 300 is, typically, of a generally cylindrical configuration. The cover 317 fits snugly over the upper portion of storage area 316. A friction fit keeps the two sections of the container 300 in closed relation. Of course, the components could be provided separately and then threadedly joined together, if so desired.

In the preferred embodiment, a shoulder 319 encircles the outer surface storage area 316 and receives the cover 317 in abutting relationship. Of course, the shoulder 319 can fully or partially encircle the storage area 316. Likewise, a shoulder (similar to shoulder 319) can be formed on the inside of the storage area 316, if so desired.

In the embodiment shown in FIG. 3, tabs 320 and 321 extend from the edges of the storage area 316 and cover 317, respectively. These tabs (or at least tab 321) are used to open the container 325 when it has been closed.

A slamming disc 400 is shown adjacent to container 300. In this instance, the game piece 400 is a relatively flat, disc-like configuration. Typically, the disc 400 is made of a dense material such as high density plastic or metal. In playing the game, slamming disc 400 is held on the fingertips of the "slamming player" and slammed down and brought into forceful contact with the top of the stack of game discs. Slamming disc 400 may be of any dimension or shape that can be accommodated comfortably on the fingertips of the player. Preferably, however, disc 400 weighs significantly more than the game discs. The game discs, like the slamming disc 400, have two planar surfaces. Typically, at least one surface of the game disc is imprinted with specialized designs or illustrations. The other surface can be left blank or without any form if imprinting, if so desired. The game discs may be constructed of paper, plastic, wood, metal or similar sturdy material. Otherwise, the playing discs (for example, playing disc 401) are of a size and dimension similar to slamming disc 400 and are capable of being stored in storage container 25.

Thus, there is shown and described a unique design and concept of an arena game. The particular configuration shown and described herein relates to a self-contained, portable game assembly. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A self-contained portable game assembly comprising, a portable playing surface having a first horizontal component and a first vertical side component joined thereto a vertical inner component joined to said horizontal component and depending therefrom, said vertical inner component spaced away from said vertical side component, a storage unit having a second horizontal component and a second vertical side component;

a plurality of tabs extending from said second horizontal component, a plurality of post structures depending from said first horizontal component to selectively interconnect with said storage unit, said post structures having a slot therein for receiving a corresponding tab on said storage unit for slidably locking said storage unit to said playing surface thereby forming an internal storage space therebetween, and storage containers selectively stowed in said internal storage space, said containers having a storage area component and a cover component which can be selectively engaged.

2. The portable game assembly recited in claim 1 including, at least one game disc.

3. The portable game assembly recited in claim 1 including, at least one slamming disc.

4. The portable game assembly recited in claim 1 including, at least one storage container selectively stowed in said internal storage space, each said containers having a storage area component and a cover component which can be selectively engaged.

5. The portable game assembly recited in claim 1 wherein, said second horizontal component includes an opening adjacent to said tabs whereby said post structure can be inserted into an opening prior to engagement with said tabs.

6. The portable game assembly recited in claim 1 wherein, said first horizontal component is larger than said second horizontal component, and said vertical inner component is aligned with said second vertical side component.

7. A portable game assembly comprising, a pair of substantially planar plates, each of said plates having a wall surface formed at the perimeter thereof, each said wall surface formed along at least a substantial portion of the perimeter of the respective plate and extending toward the other plate, at least one of said plates having a plurality of posts formed on a planar surface thereof, said posts configured to selectively engage and interlock with the other one of said plates whereby said pair of plates are mounted substantially parallel to each other with a space therebetween.

8. The game assembly recited in claim 7 including at least one storage container for use in said space, each said container having a storage area component and a cover component which are selectively engaged with each other.

9. The assembly of claim 8 wherein, each said container is a unitary molded product of plastic material.

10. The assembly of claim 8 wherein, each said container is utilized to store game discs.

11. The assembly of claim 1 wherein, said planar plate are made of plastic.

12. The game assembly recited in claim 7 wherein, at least one of said plates includes a further wall surface spaced apart from the upstanding wall surface formed at the perimeter thereof, said further wall surface arranged to mate with the wall surface formed at the perimeter of the other plate to thereby form a confined space between said pair of plates.

13. The portable game assembly of claim 1 including, game discs, said game discs having first and second planar surfaces, said planar surfaces allowing for said discs to be stacked vertically; and a slamming disc, further said slamming disc possessing significantly more weight than said game discs

14. The assembly of claim 13 wherein, at least one of said game discs and said slamming disc is made of metal.

15. The assembly of claim 13 wherein, said discs is made of plastic.

16. The assembly of claim 13 wherein, said discs are made of wood.

17. The assembly of claim 13 wherein, said discs are made of paper.

18. The assembly of claim 15 wherein, said slamming disc is made of a high-density plastic material.

* * * * *